US009769583B2

(12) United States Patent
Hsieh et al.

(10) Patent No.: US 9,769,583 B2
(45) Date of Patent: Sep. 19, 2017

(54) VIBRATION MEMBRANE ASSEMBLY FOR SPEAKER, SPEAKER AND METHOD FOR PRODUCING THE ASSEMBLY

(71) Applicant: Knowles IPC (M) Snd. Bhd., Penang (MY)

(72) Inventors: Gary Hsieh, Taipei (TW); Christian Lembacher, Gramatneusiedl (AT); Armin Timmerer, Vienna (AT); Ewald Frasl, Biedermannsdorf (AT); Bernhard Seiwald, Nikolsdorf (AT); Peter Fischer, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 14/994,944

(22) Filed: Jan. 13, 2016

(65) Prior Publication Data

US 2016/0205487 A1 Jul. 14, 2016

(30) Foreign Application Priority Data

Jan. 13, 2015 (CN) ..... 2015 1 0015897

(51) Int. Cl.
*H04R 31/00* (2006.01)
*H04R 7/22* (2006.01)

(52) U.S. Cl.
CPC ..... *H04R 31/003* (2013.01); *H04R 7/22* (2013.01); *H04R 2231/001* (2013.01); *H04R 2231/003* (2013.01)

(58) Field of Classification Search
CPC ..... H04R 31/003; H04R 31/006; H04R 7/22; H04R 2231/001; H04R 2231/003
USPC ..... 181/171; 381/386
See application file for complete search history.

(56) References Cited

U.S. PATENT DOCUMENTS 4,674,592 A * 6/1987 Aoki ..... H04R 7/02 181/170
6,799,361 B2 * 10/2004 Frasl ..... H04R 31/00 181/171
2008/0277197 A1 * 11/2008 Yang ..... H04R 7/12 181/171

FOREIGN PATENT DOCUMENTS

WO WO 0058073 A1 * 10/2000 ..... B29C 51/365

* cited by examiner

*Primary Examiner* — Jeremy Luks
(74) *Attorney, Agent, or Firm* — Steven McMahon Zeller; Dykema Gossett PLLC

(57) ABSTRACT

The present invention discloses a vibration membrane assembly for a speaker, a method for producing a vibration membrane assembly and a speaker. The assembly comprises a vibration membrane and a vibration membrane carrier ring. The method comprises providing a first thermal molding die having a molding side, the molding side having a profile which is complementary to that of the second side of the vibration membrane assembly, putting the vibration membrane carrier ring onto the molding side of the first thermal molding die and laying a vibration membrane blank onto the vibration membrane carrier ring to bring the vibration membrane blank in contact with the vibration membrane carrier ring, applying a pressure to the vibration membrane blank against the vibration membrane carrier ring to nest and fix the vibration membrane blank on the vibration membrane carrier ring to form the vibration membrane assembly, removing the pressure off the vibration membrane blank and separating the vibration membrane assembly from the first thermal molding die.

11 Claims, 7 Drawing Sheets

VIBRATION MEMBRANE ASSEMBLY FOR SPEAKER, SPEAKER AND METHOD FOR PRODUCING THE ASSEMBLY

PRIORITY

This patent application claims priority from Chinese Patent Application No. 201510015897.X, filed Jan. 13, 2015, the disclosure of which is incorporated herein, in its entirety, by reference.

BACKGROUND OF THE INVENTION a. Field of the Invention

The present disclosure relates to the field of speakers, and more particularly, to a vibration membrane assembly for a speaker, a speaker containing same and a method for producing the vibration membrane assembly.

b. Background Art

A typical speaker has a structure in which a coil is driven by alternating currents flowing through the coil to vibrate in a magnetic field so as to cause a vibration membrane connected to the coil to vibrate to create sound. In such a structure, the vibration membrane is a necessary component. In the process of producing the speaker, placement and connection of the vibration membrane is one of the key steps. In the prior art, it is typically achieved by directly gluing the pre-sized vibration membrane to a support structure.

SUMMARY OF THE INVENTION

An object of the present invention is to provide a vibration membrane assembly for a speaker which can be mounted in the speaker in an efficient and more convenient manner.

Another object of the present invention is to provide a method for producing the vibration membrane assembly which avoids the gluing process to improve the production efficiency of the speaker.

Another object of the present invention is to provide a speaker comprising the vibration membrane assembly.

The present invention may be implemented by the following embodiments.

In accordance with one aspect of the present invention, there is provided a method for producing a vibration membrane assembly for a speaker, the assembly having a first side and a second side opposite the first side and comprising a vibration membrane and a vibration membrane carrier ring. The method includes providing a first thermal molding die having a molding side, where the molding side has a profile which is complementary to that of the second side of the vibration membrane assembly. The method also includes putting the vibration membrane carrier ring onto the molding side of the first thermal molding die and laying a vibration membrane blank onto the vibration membrane carrier ring to bring the vibration membrane blank in contact with the vibration membrane carrier ring. The method next includes applying a pressure to the vibration membrane blank against the vibration membrane carrier ring to nest and fix the vibration membrane blank on the vibration membrane carrier ring to form the vibration membrane assembly. Finally, the method includes removing the pressure off the vibration membrane blank and separating the vibration membrane assembly from the first thermal molding die.

In an embodiment, the pressure may be applied by a gas around the vibration membrane blank. In a further embodiment, the step of applying a pressure to the vibration membrane blank against the vibration membrane carrier ring may comprise forming a gas chamber around the vibration membrane blank laid on the vibration membrane carrier ring to apply a gas pressure to the vibration membrane blank against the vibration membrane carrier ring to nest and fix the vibration membrane blank on the vibration membrane carrier ring to form the vibration membrane assembly.

In another embodiment, the step of applying a pressure to the vibration membrane blank against the vibration membrane carrier ring may comprise providing a second thermal molding die which is able to form, in combination with the first thermal molding die, a cavity in coincidence with a whole profile of the vibration membrane assembly and shutting off the first and the second thermal molding dies to thermally press the vibration membrane blank and the vibration membrane carrier ring in the cavity to nest and fix the vibration membrane blank on the vibration membrane carrier ring to form the vibration membrane assembly.

In a further embodiment, after shutting off the first and the second thermal molding dies, at least one part of the vibration membrane blank may be exposed from a gap between the first and the second thermal molding dies.

In an embodiment, the vibration membrane carrier ring may be provided with at least one fixing grooves, and wherein during nesting and fixing the vibration membrane blank on the vibration membrane carrier ring, a part of the vibration membrane blank is thermally pressed into the fixing grooves to fix the vibration membrane blank to the vibration membrane carrier ring.

In an embodiment, the number of the fixing grooves may be four and the four fixing grooves are arranged on four sides of the vibration membrane carrier ring respectively.

In an embodiment, the fixing grooves may have straight or wavy shaped edges.

In an embodiment, in the step of putting the vibration membrane carrier ring onto the molding side of the first thermal molding die and laying a vibration membrane blank onto the vibration membrane carrier ring to bring the vibration membrane blank in contact with the vibration membrane carrier ring, the vibration membrane blank may be wrapped around the outer periphery of the vibration membrane carrier ring.

In an embodiment, the first thermal molding the may be provided with a membrane shaping structure, for forming patterns and/or shapes required for the vibration membrane on the vibration membrane blank.

In an embodiment, the vibration membrane blank may be a foil for forming the vibration membrane.

In accordance with another aspect of the present invention, there is provided a vibration membrane assembly for a speaker, the assembly comprising a vibration membrane and a vibration membrane carrier ring, wherein the vibration membrane is nested and fixed to the vibration membrane carrier ring.

In a further embodiment, the vibration membrane carrier ring may be provided with at least one fixing grooves, and wherein a part of the vibration membrane blank is thermally pressed into the fixing grooves to fix the vibration membrane blank to the vibration membrane carrier ring.

In an embodiment, the number of the fixing grooves may be four and the four fixing grooves are arranged on four sides of the vibration membrane carrier ring respectively.

In an embodiment, the fixing grooves may have straight or wavy shaped edges.

In an embodiment, the vibration membrane blank may be wrapped around an outer periphery of the vibration membrane carrier ring.

In accordance with a further aspect of the present invention, there is provided a speaker, comprising the vibration membrane assembly as described in any of the above embodiments.

With the above aspects, the vibration membrane blank can be nested and fixed to the vibration membrane carrier ring by thermally molding to form the vibration membrane assembly for a speaker. The vibration membrane assembly, the speaker and the method for producing the vibration membrane assembly according to the present invention may eliminate the process of gluing the vibration membrane and allow for the easy recycling of the vibration membrane carrier ring.

DETAILED DESCRIPTION OF THE EMBODIMENTS

Figure 1A:
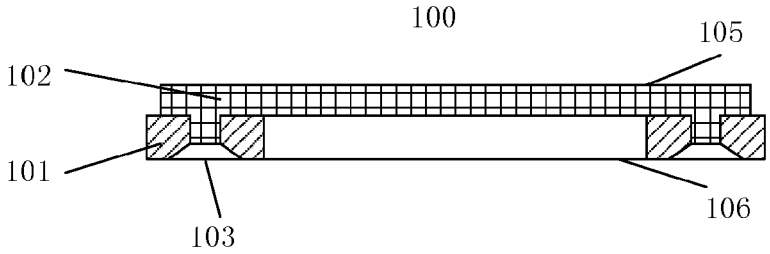
FIG. 1*a* schematically shows a vibration membrane assembly for a speaker in accordance with an embodiment of the present invention.

Technical solutions of the present invention will be described hereinafter in more detail by the way of embodiments with reference to accompanying drawings, wherein the same or like reference numerals refer to the same or like elements throughout the specification. The explanation to the embodiments of the present invention with referring to the accompanying drawings is intended to interpret the general inventive concept of the present invention, rather than being construed as a limiting to the present invention.

FIG. 1*a* shows schematically a vibration membrane assembly 100 according to an embodiment of the present invention. The vibration membrane assembly 100 includes a vibration membrane 102 and a vibration membrane carrier ring 101. In an example, the vibration membrane 102 is nested and fixed to the vibration membrane carrier ring 101. The assembly 100 may have a first side 105 and a second side 106 opposite to the first side 105. The vibration membrane assembly 100 may be produced by thermal molding. As an example, with reference to FIGS. 1*b* and 1*c*, a method for producing the vibration membrane assembly 100 may comprise:

(a) providing a first thermal molding die 201 having a molding side 211, the molding side 211 having a profile which is complementary to that of the second side 106 of the vibration membrane assembly 100;

(b) putting the vibration membrane carrier ring 101 onto the molding side 211 of the first thermal molding the 201 and laying a vibration membrane blank 112 onto the vibration membrane carrier ring 101 to bring the vibration membrane blank 112 in contact with the vibration membrane carrier ring 101;

(c) applying a pressure to the vibration membrane blank 112 against the vibration membrane carrier ring 101 to nest and fix the vibration membrane blank 112 on the vibration membrane carrier ring 101 to form the vibration membrane assembly 100; and (d) removing the pressure off the vibration membrane blank 112 and separating the vibration membrane assembly 100 from the first thermal molding the 201.

Figure 1B:
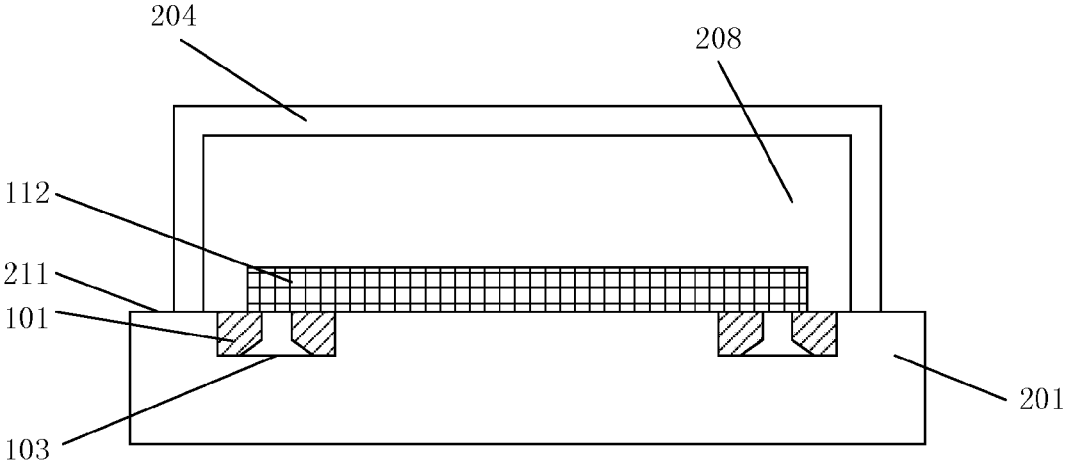
FIG. 1*b* schematically shows a method for producing the vibration membrane assembly shown in FIG. 1*a* in accordance with an embodiment of the present invention.

In an example, the pressure is applied by a gas around the vibration membrane blank 112. For example, as illustrated in FIG. 1*b*, a casing 204 may be provided to cover the vibration membrane blank 112 laid on the vibration membrane carrier ring 101 to form a gas chamber 208. The gas chamber 208 is filled with the gas, e.g., by a gas pump (unshown), to form a certain pressure around the vibration membrane blank 112. The gas may be such as air, argon, nitrogen, and so on. The pressure and temperature of gas within the gas chamber 208 may be adjusted as required. As an example, the gas within the gas chamber 208 may have a variable work temperature between a lower temperature limit which may be in a range of 20° C.-90° C. and an upper temperature limit which may be in a range of 130° C.-200° C. In an example, the gas within the gas chamber 208 may have a variable work pressure between a lower pressure limit which may be in a range of 0 bar-2 bar and an upper pressure limit which may be in a range of 2 bar-20 bar. With the gas chamber 208, the pressure may be applied to the vibration membrane blank 112 more uniformly.

In an example, the step of applying a pressure to the vibration membrane blank 112 against the vibration membrane carrier ring 101 may include: forming a gas chamber 208 around the vibration membrane blank 112 laid on the vibration membrane carrier ring 101 to apply a gas pressure to the vibration membrane blank 112 against the vibration membrane carrier ring 101 to nest and fix the vibration membrane blank 112 on the vibration membrane carrier ring 101 to form the vibration membrane assembly 100.

Figure 1C:
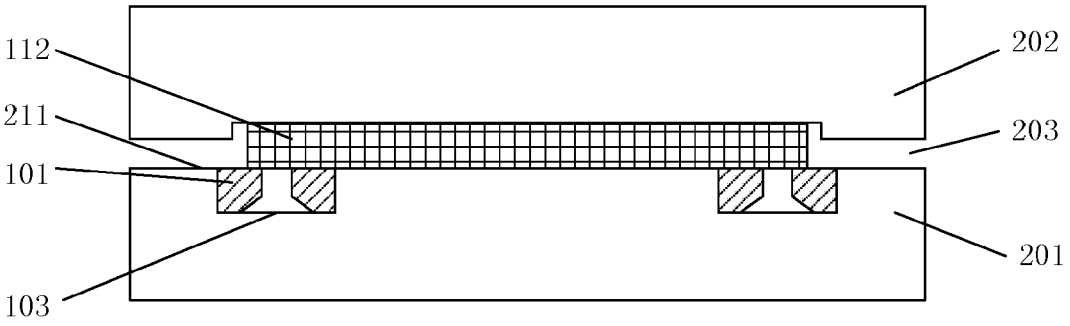
FIG. 1*c* schematically shows a method for producing the vibration membrane assembly shown in FIG. 1*a* in accordance with a further embodiment of the present invention.
Figure 2:
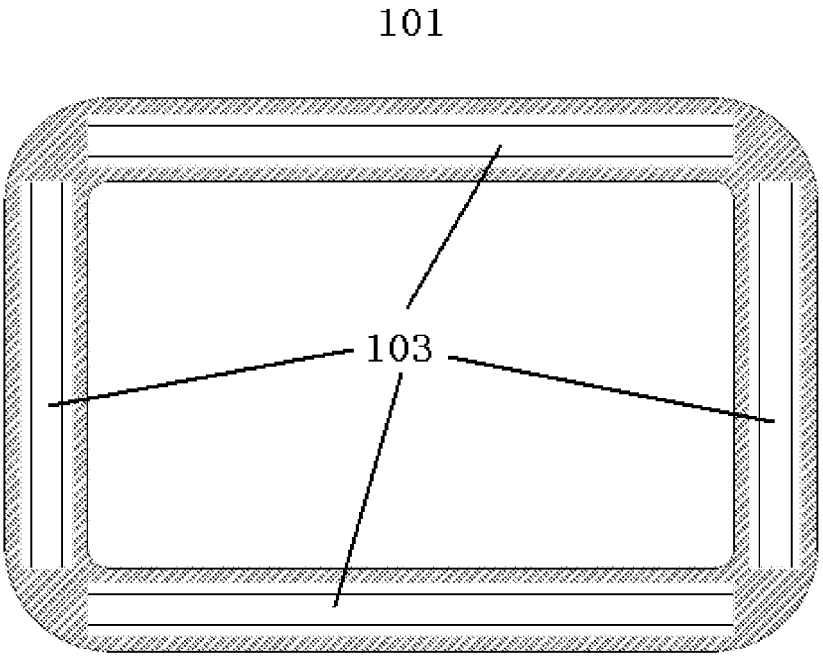
FIG. 2 is a schematic view of a vibration membrane carrier ring in accordance with an embodiment of the present invention.
Figure 3:
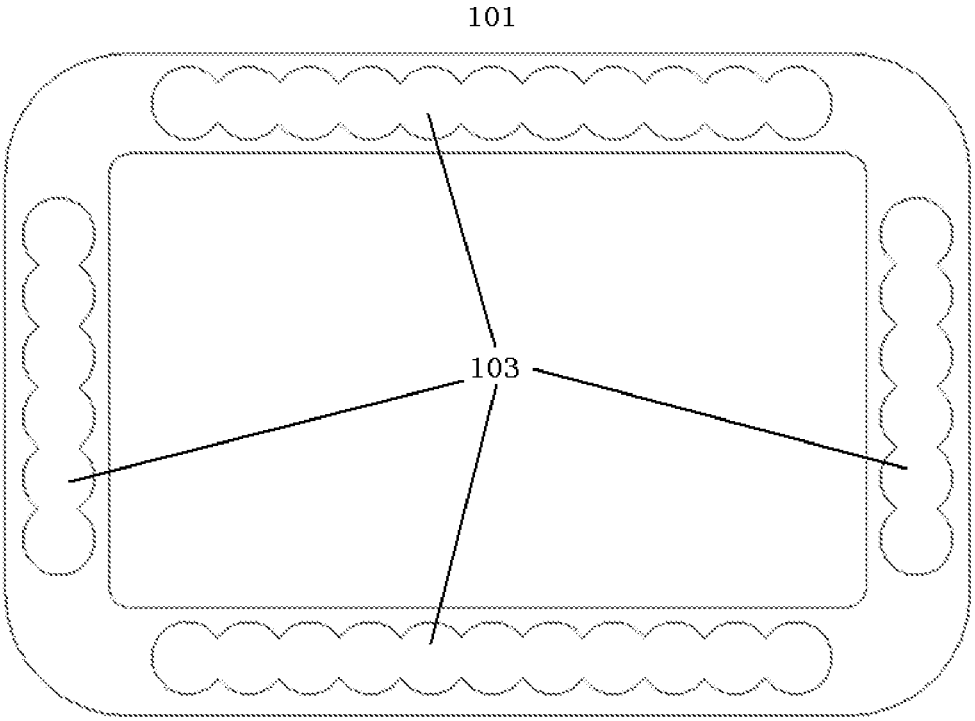
FIG. 3 is a schematic view of a vibration membrane carrier ring in accordance with an embodiment of the present invention.
Figure 4:
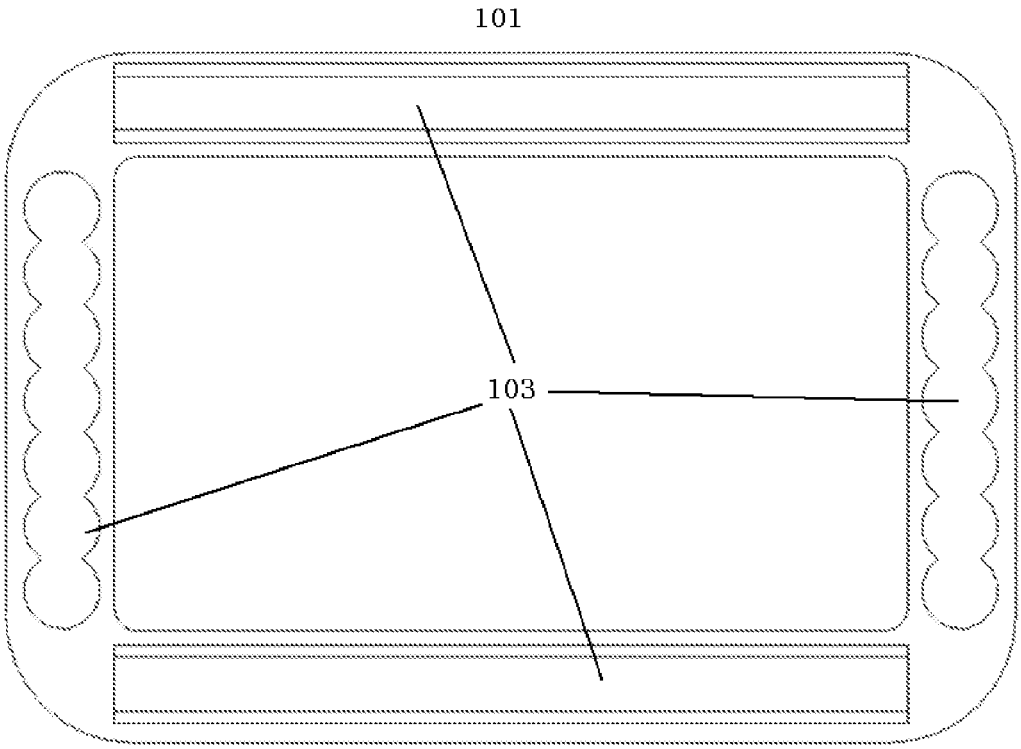
FIG. 4 is a schematic view of a vibration membrane carrier ring in accordance with an embodiment of the present invention.
Figure 5:
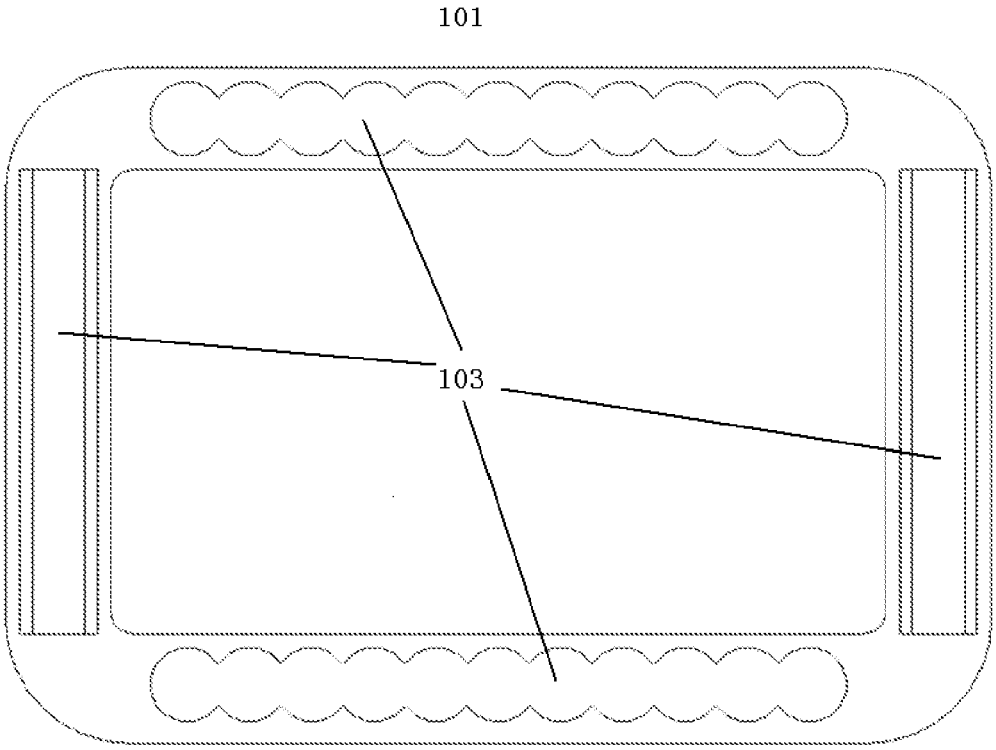
FIG. 5 is a schematic view of a vibration membrane carrier ring in accordance with an embodiment of the present invention.

In an example, as shown in FIGS. 1*a*-1*c*, the vibration membrane carrier ring 101 is provided with fixing grooves 103. In the step of nesting and fixing the vibration membrane blank 112 to the vibration membrane carrier ring 101, a part of the vibration membrane blank 112 is thermally pressed into the fixing grooves 103 to fix the vibration membrane blank 112 to the vibration membrane carrier ring 101.

In the example shown in FIG. 1*b*, the gas pressure within the gas chamber 208 forces a part of the vibration membrane blank 112 into the fixing grooves 103 to integrate the vibration membrane blank 112 with the vibration membrane carrier ring 101.

Alternatively, the step of applying a pressure to the vibration membrane blank 112 against the vibration membrane carrier ring 101 may include: providing a second thermal molding die 202 which is able to form, in combination with the first thermal molding the 201, a cavity in coincidence with a whole profile of the vibration membrane assembly 100 and pressing together the first and the second thermal molding dies 201, 202 to thermally press the vibration membrane blank 112 and the vibration membrane carrier ring 101 in the cavity to nest and fix the vibration membrane blank 112 on the vibration membrane carrier ring 101 to form the vibration membrane assembly 100.

As shown in FIG. 1*c*, the vibration membrane blank 112 has been laid on the vibration membrane carrier ring 101, but the first thermal molding the 201 and the second thermal molding die 202 have not been pressed together completely. It should be noted that the vibration membrane blank 112 is illustrative. In practice, the vibration membrane blank 112 may have a much larger area, for example, it may be exposed from a gap 203 between the first thermal molding the 201 and the second thermal molding the 202. When the first thermal molding the 201 and the second thermal molding the 202 are pressed together to carry out the step of thermally pressing, the first thermal molding die 201 and the second thermal molding die 202 extrude the vibration membrane blank 112 in a lateral direction. Part of the vibration membrane blank 112 is thermally pressed into the fixing grooves 103 to form a structure corresponding to the vibration membrane assembly 100.

Seen from FIGS. 1*a*-1*c*, in the course of producing the assembly 100, a part of the vibration membrane blank 112 is thermally pressed into the fixing grooves 103. In this way, any adhesives or glues for connecting the vibration membrane blank 112 and the vibration membrane carrier ring 101 will not be needed. Thus, the overall production process may be simplified.

Figure 6:
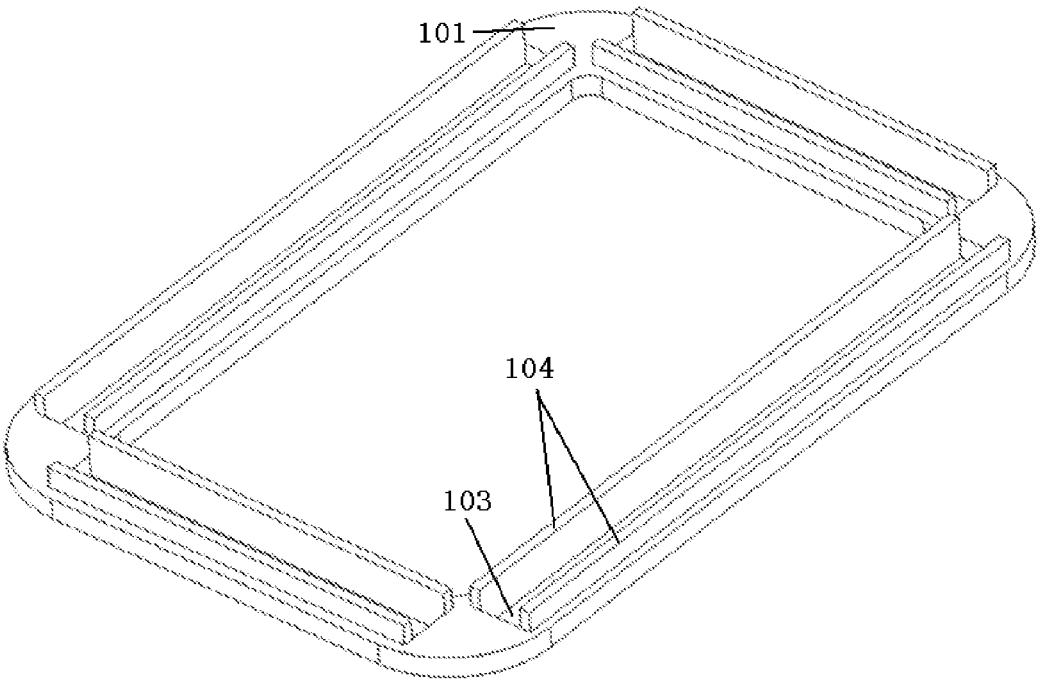
FIG. 6 is a schematic view of a vibration membrane carrier ring in accordance with an embodiment of the present invention.

FIGS. 2-6 show various examples of structures of the vibration membrane carrier ring 101 with the fixing grooves 103. As an example, there may be four fixing grooves 103 arranged on four sides of the vibration membrane carrier ring 101 respectively. However, the number of the fixing grooves 103 is not limited to four and may be, for example, one, two, three, six, eight, etc. As an example, the fixing grooves 103 may have straight edges, or may have wavy shaped edges, as shown in FIGS. 2-6. In an example, the fixing grooves with the straight edges and those with the wavy shaped edges may both be arranged on the same vibration membrane carrier ring 101. In an example, a pair of upright plates 104 for supporting the vibration membrane 102 may be provided in the fixing grooves 103, as shown in FIG. 6.

In an embodiment, as shown in FIGS. 7*a*-8*b*, the vibration membrane blank 112 may be thermally joined to the vibration membrane carrier ring 101 together by wrapping the vibration membrane blank 112 around the outer periphery of the vibration membrane carrier ring 101. In this case, the vibration membrane assembly 100' for the speaker may not necessarily be provided with the fixing grooves 103. However, as an example, the combination of both the fixing grooves 103 and the vibration membrane blank 112 wrapped around the outer periphery of the vibration membrane carrier ring 101 may also be used to achieve the nested joining of the vibration membrane blank 112 and the vibration membrane carrier ring 101.

Figure 8A:
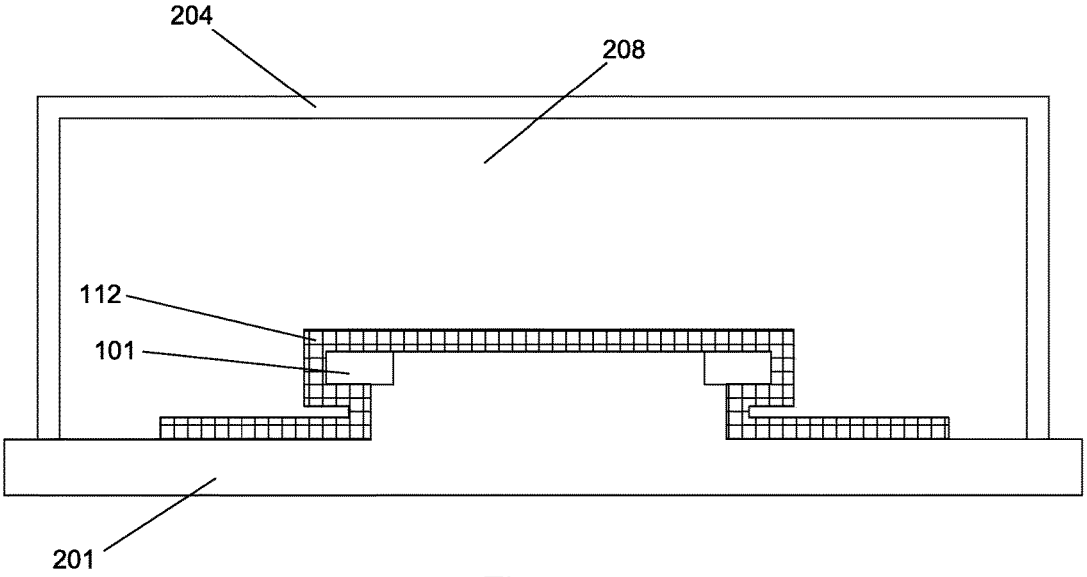
FIG. 8*a* schematically shows a method for producing the vibration membrane assembly in accordance with a further embodiment of the present invention.
Figure 8B:
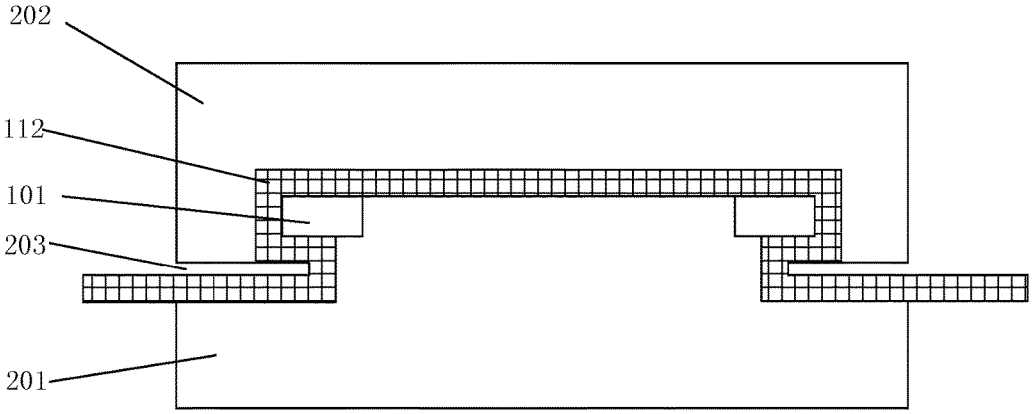
FIG. 8*b* schematically shows a method for producing the vibration membrane assembly in accordance with a further embodiment of the present invention.

As an example, the area of the vibration membrane blank 112 may only wrap the outer periphery of the vibration membrane carrier ring 101, or the vibration membrane blank 112 may have a larger area, for example, at least one part of the vibration membrane blank 112 may be exposed from the gap 203 between the first thermal molding the 201 and the second thermal molding the 202 after the first thermal molding the 201 and the second thermal molding the 202 are pressed together, as shown in FIG. 8*b*. Similarly, as an example, at least one part of the vibration membrane blank 112 may also be exposed from a gap between the first thermal molding die 201 and the casing 204, as shown in FIG. 8*a*.

In the embodiment that the vibration membrane blank 112 is wrapped around the outer periphery of the vibration membrane carrier ring 101, the vibration membrane blank 112 may also be pressed and fixed on the vibration membrane carrier ring 101 by the gas chamber 208 and the first thermal molding the 201 (see FIG. 7*b* and FIG. 8*a*) or by the first thermal molding the 201 and the second thermal molding die 202 (see FIG. 7*c* and FIG. 8*b*), similar to the embodiments shown in FIGS. 1*a*-1*c*.

As an example, the vibration membrane blank 112 may be pressed into a shape which is substantially complementary to that of the outer periphery of the vibration membrane carrier ring 101 and be wrapped around the outer periphery. In this way, the vibration membrane blank 112 may be fixed on the vibration membrane carrier ring 101 without any adhesives.

Figure 9A:
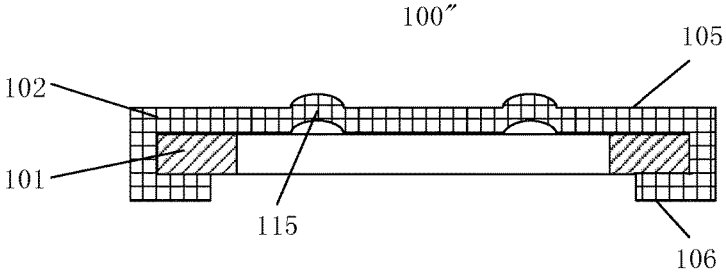
FIG. 9*a* schematically shows a vibration membrane assembly with patterns and/or shapes of the vibration membrane for a speaker in accordance with another embodiment of the present invention.
Figure 9B:
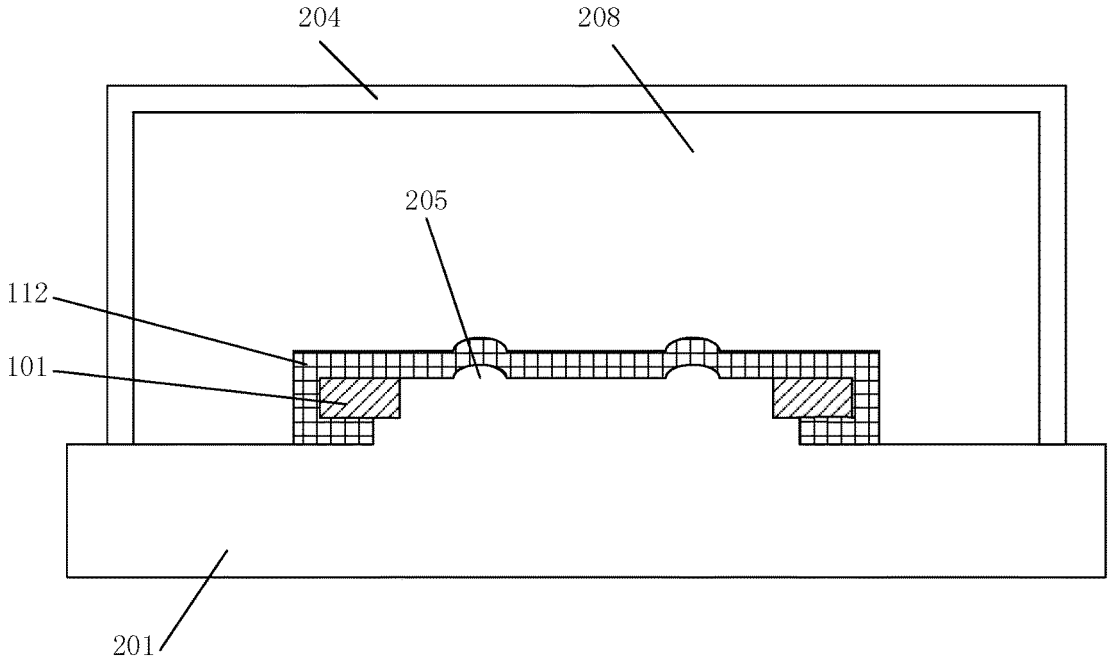
FIG. 9*b* schematically shows a method for producing the vibration membrane assembly shown in FIG. 9*a* in accordance with another embodiment of the present invention.
Figure 9C:
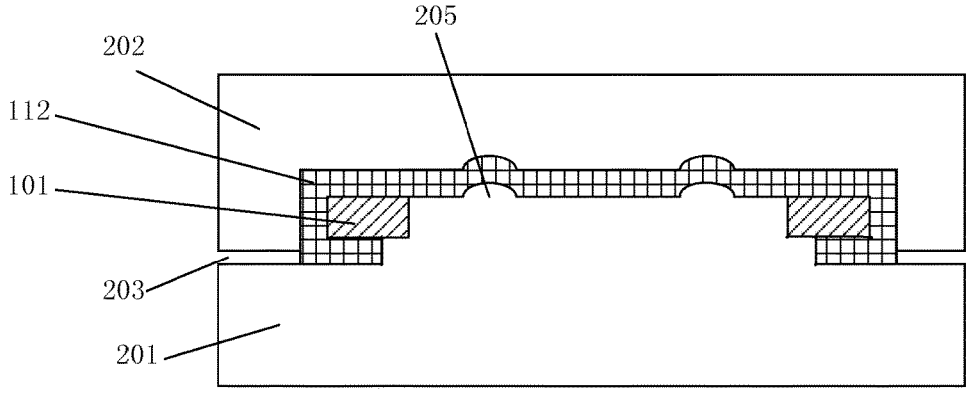
FIG. 9*c* schematically shows a method for producing the vibration membrane assembly shown in FIG. 9*a* in accordance with another embodiment of the present invention.

Although the vibration membrane 102 in FIGS. 1*a*-1*c* is shown in flat form, in practice, the vibration membrane 102 may have certain patterns and/or shapes. For example, as shown in FIG. 9*a*, vibration membrane assembly 100" has a vibration membrane 102 having annulus grooves, or a conical shape. In an example, as illustrated in FIGS. 9*a*-9*c*, the first thermal molding die 201 is provided with a membrane shaping structure 205, for example a protrusion or a recess, for forming patterns and/or shapes required for the vibration membrane 102 on the vibration membrane blank 112. In this way, the molding of the vibration membrane 102 and the thermally joining of the vibration membrane 102 and the vibration membrane carrier ring 101 may be achieved in the same step to simplify the process. Although FIGS. 9*a*-9*c* show that the vibration membrane 102 has an annulus pattern 115 projected upwardly, the vibration membrane 102 may have any patterns and/or shapes required for design of the speaker, such as, for example, a concave shape or a pattern of corrugation. For the case that the first thermal molding the 201 and the second thermal molding the 202 are used in combination, for example, the membrane shaping structure 205 may alternatively be provided in the second thermal molding die 202 or both in the second thermal molding die 202 and in the first thermal molding die 201 (see FIG. 9*c*).

In an example, the vibration membrane blank 112 may be a foil for forming the vibration membrane 102, and may be made of, for example, plastics or fibres. The vibration membrane carrier ring 101 may be, as an example, made of plastics or metals.

The vibration membrane assembly 100, 100', 100" according to the present invention may be mounted and fixed in the speaker conveniently by the vibration membrane carrier ring 101. The method for producing the vibration membrane assembly according to the present invention uses the form of nesting and fixing the vibration membrane 101, which can avoid the process of gluing the vibration membrane 102 to the carrier ring or supporter, and can allow the vibration membrane carrier ring 101 to be recycled easily. As it omits the process of gluing, it may reduce the complexity of the production process and reduce the pollution to the environment.

Figure 7A:
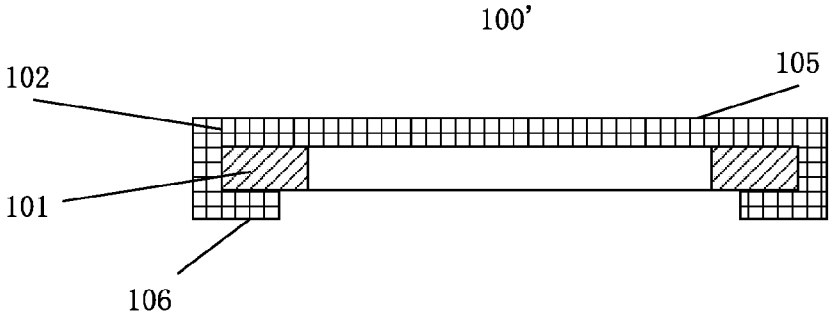
FIG. 7*a* schematically shows a vibration membrane assembly for a speaker in accordance with another embodiment of the present invention.
Figure 7B:
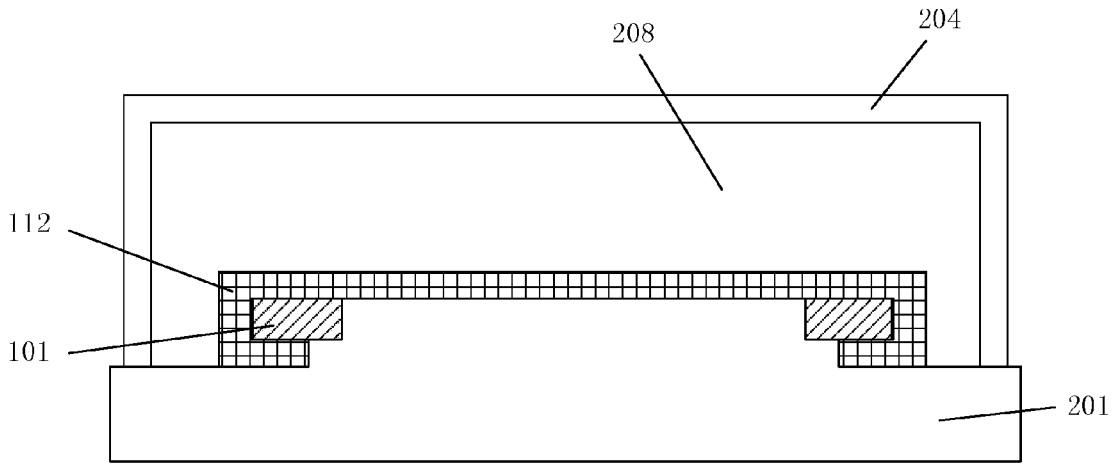
FIG. 7*b* schematically shows a method for producing the vibration membrane assembly shown in FIG. 7*a* in accordance with another embodiment of the present invention.
Figure 7C:
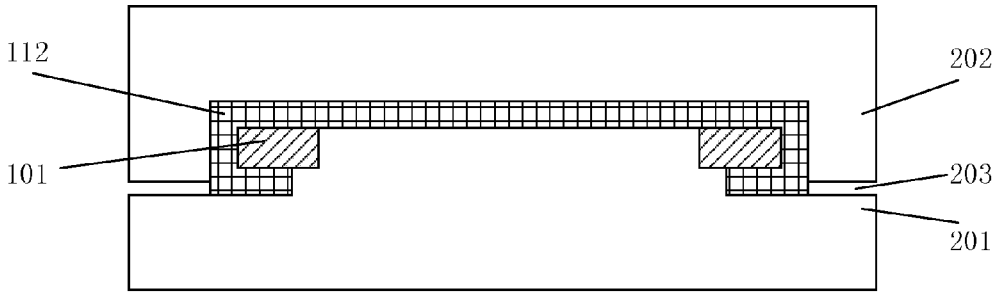
FIG. 7*c* schematically shows a method for producing the vibration membrane assembly shown in FIG. 7*a* in accordance with another embodiment of the present invention.

Although FIGS. 1*b*, 7*b* and 8*a* show the gas chamber 208 only cooperates with one first thermal molding die 201 to form one vibration membrane assembly 100, it is only in the way of example, and is not intended to limit the present invention. As an example, one gas chamber 208 may alternatively cover a plurality of carrier rings 101 on which the vibration membrane blank 112 are laid and cooperate with a plurality of first thermal molding dies 201, for example an array of first thermal molding dies 201, so as to form a plurality of vibration membrane assemblies 100 in one process. In this way, the plurality of vibration membrane assemblies 100 may be produced in the same process by means of only one gas chamber 208. It may improve the throughput efficiently.

The principle and general concept of the present invention have been explained above with reference to the specific examples with fixing grooves provided on the vibration membrane carrier ring and those with the vibration membrane carrier ring around which the vibration membrane blank is wrapped. However, the embodiments of the present invention are not limited to these described. Other structures or means which are able to nest and fix the vibration membrane blank to the vibration membrane carrier ring also fall within the scope of the present invention.

The present invention also relates to a speaker including the vibration membrane 100, 100', 100" as described in any of above examples. According to requirement of design, the speaker may further include various known components in the prior art, such as a magnet conductive plate, an inner magnet, an outer magnet, a coil, a membrane plate, a housing, etc.

Although the present invention has been explained with reference to the Figures, the embodiments shown in Figures are only illustrative, and do not limit the present invention.

Although some embodiments of the general inventive concept are illustrated and explained, it would be appreciated by those skilled in the art that modifications and variations may be made in these embodiments without departing from the principles and spirit of the general inventive concept of the disclosure, the scope of which is defined in the appended claims and their equivalents.

What is claimed:

1. A method for producing a vibration membrane assembly for a speaker, the assembly having a first side and a second side opposite to the first side, and comprising a vibration membrane and a vibration membrane carrier ring, the method comprising:

providing a first thermal molding die having a molding side, the molding side having a profile which is complementary to that of the second side of the vibration membrane assembly;

putting the vibration membrane carrier ring onto the molding side of the first thermal molding die; and laying a vibration membrane blank onto the vibration membrane carrier ring to bring the vibration membrane blank in contact with a top side of the vibration membrane carrier ring and wrapped around an outer periphery of the vibration membrane carrier ring;

applying a pressure to the vibration membrane blank against the vibration membrane carrier ring to nest and fix the vibration membrane blank on the vibration membrane carrier ring to form the vibration membrane assembly; and removing the pressure off the vibration membrane blank and separating the vibration membrane assembly from the first thermal molding die.

2. The method according to claim 1, wherein the pressure is applied by a gas around the vibration membrane blank.

3. The method according to claim 2, wherein the step of applying a pressure to the vibration membrane blank against the vibration membrane carrier ring comprises:

forming a gas chamber around the vibration membrane blank laid on the vibration membrane carrier ring; and applying a gas pressure to the vibration membrane blank against the vibration membrane carrier ring to nest and fix the vibration membrane blank on the vibration membrane carrier ring to form the vibration membrane assembly.

4. The method according to claim 1, wherein the step of applying a pressure to the vibration membrane blank against the vibration membrane carrier ring comprises:

providing a second thermal molding die which is able to form, in combination with the first thermal molding die, a cavity in coincidence with a whole profile of the vibration membrane assembly; and pressing together the first and the second thermal molding dies to thermally press the vibration membrane blank and the vibration membrane carrier ring in the cavity to nest and fix the vibration membrane blank on the vibration membrane carrier ring to form the vibration membrane assembly.

5. The method according to claim 4, wherein after pressing together the first and the second thermal molding dies, at least one part of the vibration membrane blank is exposed from a gap between the first and the second thermal molding dies.

6. The method according to claim 1, wherein the vibration membrane carrier ring is provided with at least one fixing grooves, and wherein during nesting and fixing the vibration membrane blank on the vibration membrane carrier ring, a part of the vibration membrane blank is thermally pressed into the fixing grooves to fix the vibration membrane blank to the vibration membrane carrier ring.

7. The method according to claim 6, wherein the number of the fixing grooves is four and the fixing grooves are arranged on separate sides of the vibration membrane carrier ring.

8. The method according to claim 6, wherein the fixing grooves have straight or wavy shaped edges.

9. The method according to claim 1, wherein in the step of laying a vibration membrane blank onto the vibration membrane carrier ring, the vibration membrane blank is also brought in contact with at least a portion of a bottom side of the vibration membrane carrier ring opposite the top side.

10. The method according to claim 1, wherein the first thermal molding die is provided with a membrane shaping structure for forming patterns and/or shapes on the vibration membrane blank.

11. The method according to claim 1, wherein the vibration membrane blank is a foil.

* * * * *